United States Patent [19]

Tierney

[11] Patent Number: 4,802,613

[45] Date of Patent: Feb. 7, 1989

[54] INSTRUMENT SUPPORT APPARATUS

[76] Inventor: Mark D. Tierney, 709 Cramer Ave. Schenectady, N.Y. 12306

[21] Appl. No.: 939,618

[22] Filed: Dec. 8, 1986

Related U.S. Application Data

[63] Continuation of Ser. No. 771,904, Sep. 3, 1985, abandoned.

[51] Int. Cl.[4] ..... A45F 3/02

[52] U.S. Cl. ..... 224/204; 224/910

[58] Field of Search ..... 224/910, 257, 258, 259, 224/202, 204, 209; 84/453, 385 A

[56] References Cited

U.S. PATENT DOCUMENTS 3,129,863 4/1964 Haugen et al. ..... 224/910 X
3,152,738 10/1964 Worsfold, Jr. ..... 224/259
4,630,763 12/1986 Friedman ..... 224/910 X

FOREIGN PATENT DOCUMENTS 134785 3/1952 Sweden ..... 224/259

*Primary Examiner*—Henry J. Recla
*Assistant Examiner*—Robert M. Petrik

[57] ABSTRACT

The invention disclosed is a novel strap assembly for supporting a musical instrument, such as a saxophone by distributing the weight of the instrument across the back and shoulders of the user symmetrically.

The strap assembly is comprised of a pair of shoulder straps being attached across the back of the user by two elongate projections and joined around the front of the user by two additional elongate projections. The pair of shoulder straps extend over the shoulders toward the front of the user, and are provided with a method for adjustable support of the instrument.

3 Claims, 3 Drawing Sheets

INSTRUMENT SUPPORT APPARATUS

This is a continuation of application Ser. No. 06/771,904, filed 9-3-85, now abandoned.

BACKGROUND AND SUMMARY OF THE INVENTION

Certain musical instruments, for example, saxophones and bass clarinets are fairly heavy instruments which require great manual maneuverability on the part of the player to operate the valves of the instrument. Therefore, it is not possible to both support such instruments in the hands of the player and allow the necessary freedom of hand and finger movement. The prior art has provided a number of types of support for musical instruments such as saxophones, including apparatus for transferring the weight of the instrument from the neck of the user to the floor, such as shown in U.S. Pat. No. 3,266,766 to Linville, or to the knee of the player, such as shown in U.S. Pat. No. 1,932,800 to Myers. The use of these types of support apparatus severely restricts the mobility of the player, and is completely unusable in, for example, a marching band. The most commonly used prior art support device is the neck strap which places the weight of the instrument on the back of the player's neck, leaving the player a high degree of both manual and bodily mobility. The neck, however, is a relatively weak part of the body and a tener saxophone weighs between nine and ten pounds, and a barritone saxophone approximately twenty pounds. The support of such weights results in undue restriction of blood flow, strain on cervical vertebrae, related nerves and muscles causing substantial discomfort and fatigue when playing an instrument thus supported for an extended period of time, particularly if the playing of the instrument is accompanied by substantial movement of the player's body, such as in a marching band. An attempt has been made in the prior art to overcome the disadvantage of neck straps by providing a shoulder strap as described in U.S. Pat. No. 3,129,863 to Haugen, et al. This apparatus takes the weight of the saxophone off the neck of the player but has the disadvantages of changing the position of the instrument from the familiar position, and of supporting the instrument asymmetrically from the player's body causing difficulty in carrying and manipulating the valves of the instrument. Additionally, some detrimental restriction of arm movement, is experienced with this type of shoulder strap.

The following examples of prior art listed and examined herein, although somewhat similar in appearance and form, were not designed specifically for the support of musical instruments, as is the intent of the present invention.

U.S. Pat. No. 2,855,133 to H. E. Mullin differs from this invention in that the position of the harness and trip-hook is actually worn in reverse, combined with the fact that the attachment labeled plate 22 of FIG. 1 of Mullin's invention permanently fixes shoulder straps 14 and 16 to the rear section of body-encircling belt 18.

It should be noted that the present invention, as clearly shown in FIG. 4, does not employ this permanent attachment, since this would severely restrict the necessary mobility that is essential to the successful performance and purpose of this invention.

Similar restriction is inherent in U.S. Pat. No. 2,169,080 to R. K. Clark in that shoulder straps 14 and 14' of FIG. 1 shown in Clark's invention are limited from outwardly movement due to their permanent attachment to the front portion of the body encircling belt 22. This example also illustrates that the preferred method of a musician to freely hold the instrument in a forwardly extended position, accomplished by the present invention, is not possible utilizing the Clark invention.

U.S. Pat. No. 1,650,491 to J. F. Calvert is the least applicable to the present invention due to the fact of major differences in configuration; specifically, the belts utilized for attaching the vest to user hold the front section of the game carrier closely to the chest, thereby restricting movement in a similar fashion to Clark's and Mullin's inventions. More importantly, the looped game holders, if employed for the same purpose of this present invention, would cause an uneven weight distribution due to the asymmetrical bearing of the musical instrument when attached to said looped game holders, thus defeating the comfortable symmetry and adjustability appreciated by the present invention.

U.S. Pat. No. 3,152,738 to J. E. Worsfold shows a camera carrying harness made of elastic bands, and is intended to secure said camera, or like object to the chest of the wearer in a protective manner. The resiliency of the elastic allows the wearer to bring the camera to eye level at a moments notice, without any timely adjustments being made.

The elasticity is essential to the proper function of the apparatus, however elastic bands have been experimented with in earlier prototypes of present invention, and have proven unsatisfactory when used with heavy instruments, such as a saxophone.

For example, if elastic bands were used to support a saxophone, the instrument would be held too tightly against the body, or would extend the elastic fully so that the resiliency would serve no useful purpose. Furthermore, Worsfold shows four separate connections to the camera, two on each side, and shows no means for adjusting the shoulder straps across back of the wearer. The present invention, however, supports an instrument at only one point in front of the wearer, and has the shoulder straps connected across the back for different sizes and proper weight distribution. These differences clearly show that Worsfold's invention cannot function in the manner that the present invention was designed for.

Other known devices for supporting the weight of a musical instrument from the body are described in U.S. Pat. No. 4,630,763 to Friedman, and in Swedish Pat. No. 134,785 to Anderson. Friedmand's invention is an apparatus for supporting the weight of a banjo, consisting of a first strap means connected to 2 separate points at respective sides of the banjo, which encircle the waist and are connected behind the wearer at one point to 2 shoulder straps. Said shoulder straps extend from this one point over each shoulder to the front and are connected at one point to the top of the banjo. The weight distribution is divided between each shoulder and the waist. One important difference between the present invention and Friedman's, is that the banjo harness is connected to the instrument at 3 separate places, offering stability and restricting any forward motion of said instrument, whereas the present invention is connected to the saxophone at only one point, allowing freedom of movement of the instrument.

Another difference is that Friedman supports a fraction of the banjo weight on the waist or hips, whereas with the present invention the entire weight of the instrument is supported by the back and shoulders. As with Worsfold, Friedman also has no means for adjusting shoulder straps across the back of the wearer.

Since both shoulder straps are more or less parallel to each other, if, for example, a saxophone were connected to the one point in front, the outward motion of the instrument when playing would cause the said shoulder straps to pull together and rub along the sides of the neck. In the present invention, since the 2 shoulder straps are separated by a back belt and extend to one point over the shoulders to the saxophone, a triangle is formed, and this keeps the shoulder straps off the sides of the neck.

In Swedish Pat. No. 134,785, Anderson's accordion harness may appear similar to FIG. 3 of the present invention, however, functionally they are very different. The accordion harness was designed to support the weight of the instrument on the hips of the player while the shoulders held said instrument in an upright position. The fact that there is only one place on a saxophone in which to attach a support apparatus, it would be virtually impossible to support said saxophone from the hips.

Anderson's carrying device is attached to the accordion at 4 separate places, and is designed to keep the accordion in a stable position when playing. As stated before, contrary to this, the present invention connects to the instrument at only one point, allowing maximum freedom of movement of said instrument. Another feature of Anderson's is the hook and buckle assembly (4), which interconnects the 2 shoulder straps at the corners around the player's back at the waist, and the closer the corners are, the more weight is on the player's hips. In order for the device to function properly, the back connection cannot be placed anywhere else but at the corners, and when fastened it creates a body encircling belt of sorts, placing the weight of accordion on the hips, as is the purpose. If the buckle and hook assembly were place higher on the shoulder straps, the circumference of the strap around the player's hips would increase, and therefore more weight would be placed on the shoulders, defeating the purpose of the invention.

The present invention differs from this, in that it does not employ a body encircling belt. It does encircle the body, however, the circumference is greater than that of a complete circle. It was designed with the back strap substantially higher than the front strap to allow for chest expansion when breathing, and when the 2 shoulder straps are connected across the back, the back strap is centered with relation to the top of the shoulders and where the front strap extends around the wearer's chest, providing a stable, more comfortable fit. Note that the front strap of present invention is attached around the chest, just under the pectorals, and not around the waist or abdomen.

In summary, Worsfold, Friedman, and Anderson all have more than one attachment to the instrument being supported, in order to keep said instrument in a stable position. The present invention is attached to the instrument at only one point, which allows for maximum freedom of movement of said instrument, a necessary feature when playing the saxophone.

The present invention disclosed herein seeks to solve the limitation and problems herein above ascribed to prior art supports by providing a support which transfers the weight of the instrument symmetrically across the back and shoulders of the player without causing arm and finger movement restriction, neck strain or restriction in blood flow.

This invention has the added advantage of retaining the original favorable features of the neckstrap such as: the ability to be worn by both sexes, the convenience of use while in a sitting or standing position, or while marching and the general freedom of movement necessary in the manipulation of the instrument.

BRIEF DESCRIPTION OF THE INVENTION

This invention relates to improvements in support apparatus for musical instruments, especially but not exclusively for use with saxophones and bass clarinets.

The primary object of this invention is to provide a much more comfortable method of supporting the instrument while in use by redistributing the weight of the instrument symmetrically across the back and shoulders of the musician, thus alleviating the pressure on the muscles, nerves and cervical vertebrae, which are aggravated during the use of neck straps that are currently in use by today's musicians.

Another object of the invention is to provide an instrument support apparatus which still permits the user to enjoy the same freedom of movement offered by said neck straps without any adverse strain applied directly to the neck.

Other important objects and advantages of the invention will become apparent from the following description and the accompanying drawings, wherein, for purposes of illustration only, a specific form of the invention is set forth in detail.

DETAILED DESCRIPTION OF DRAWINGS

Referring now specifically to the drawings, the numeral 20 generally designates the support apparatus and the numeral 30 designates the instrument, in this case, a saxophone.

Figure 4:
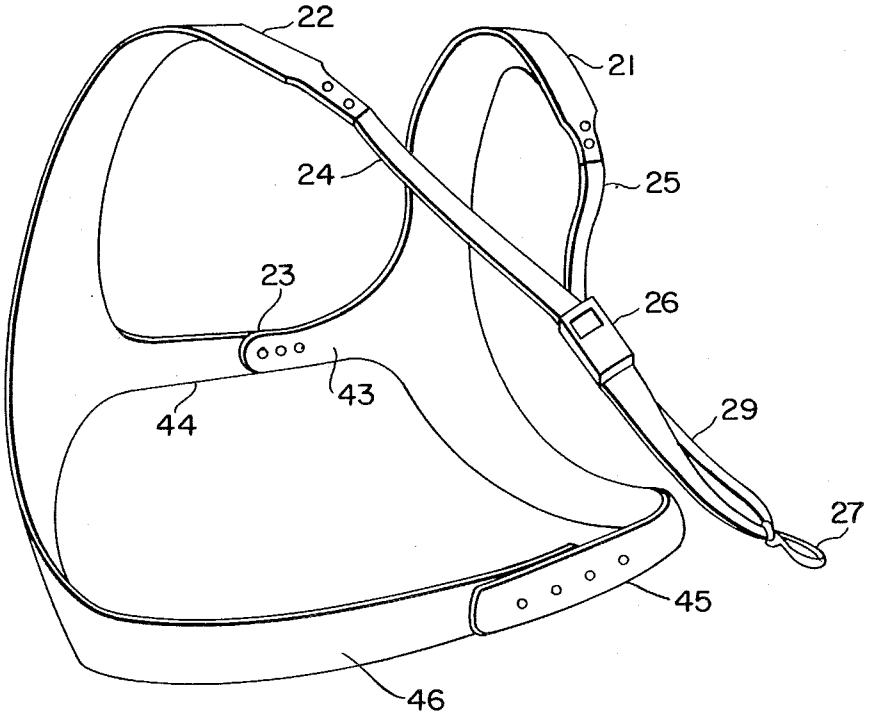
FIG. 4 is a perspective view of the entire support apparatus as it would appear in form when worn by a musician.

The support apparatus, 20 comprised essentially of a pair of shoulder straps designated by numerals 21 and 22 respectively each being joined across the back of the user by elongate projections, 43 and 44 and joined around the front of the user by elongate projections 45 and 46 respectively as clearly shown in FIG. 4. As shown in the drawings, members 21,22,43,44,45, and 46 are essentially belt like members.

Figure 1:
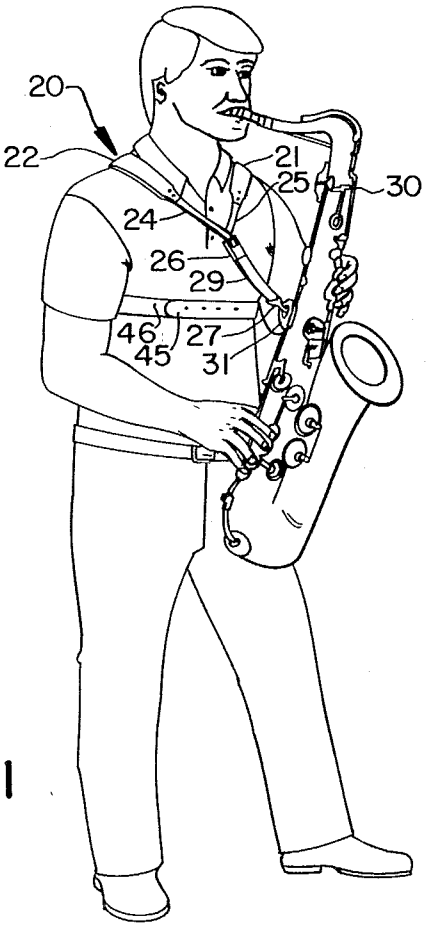
FIG. 1 is a front elevation view of a tenor saxophone suspended from the shoulders of a musician by the support apparatus of the present invention.

Said support apparatus, 20 may be formed of any material having suitable strength and flexibility, such as, for example, heavy woven cloth, plastic, or leather, and of which leather is preferred for aesthetic reasons. The shoulder straps, 21 and 22 extending over the shoulders of the user, to his front, as shown in FIG. 1, have attached respectively thereto webbing elements 24 and 25, which are permanently attached to said straps 21 and 22 by rivetted fasteners 61 and 62, although a plurality of fasteners may be used.

Said webbing elements 24 and 25 are then joined together by adjustable clamp 26 from which depending webbing element 29 extends, having hook 27 attached to the lower end thereof. Hook 27 engages ring 31 on saxophone 30 to provide for support of saxophone 30 by the apparatus of this invention. Webbing elements 24 and 25, clamp 26, the depending webbing element 29, and hook 27 may advantageously be identical elements with those well-known in the art which are connected to conventional neck straps, and do not form a part of this invention except in combination with the support apparatus comprising flexible members 21 and 22.

Figure 2:
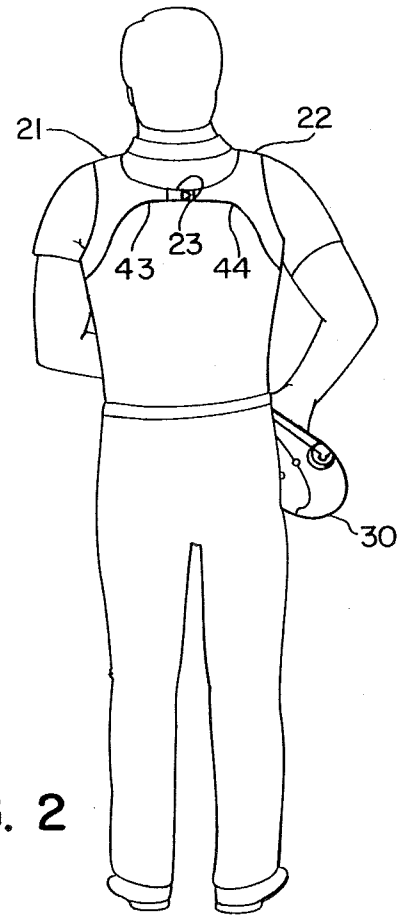
FIG. 2 is a rear elevation view of the support apparatus as it appears while being worn by the musician, showing adjustable buckle fastener which joins both shoulder straps across the back of the player.

As clearly shown in FIG. 2 elongate projections 43 and 44 are joined across the back of the user with adjustable fastener 23, shown herein as a buckler, however, any appropriate method for adjustably securing projections 43 and 44 may be employed.

Figure 3:
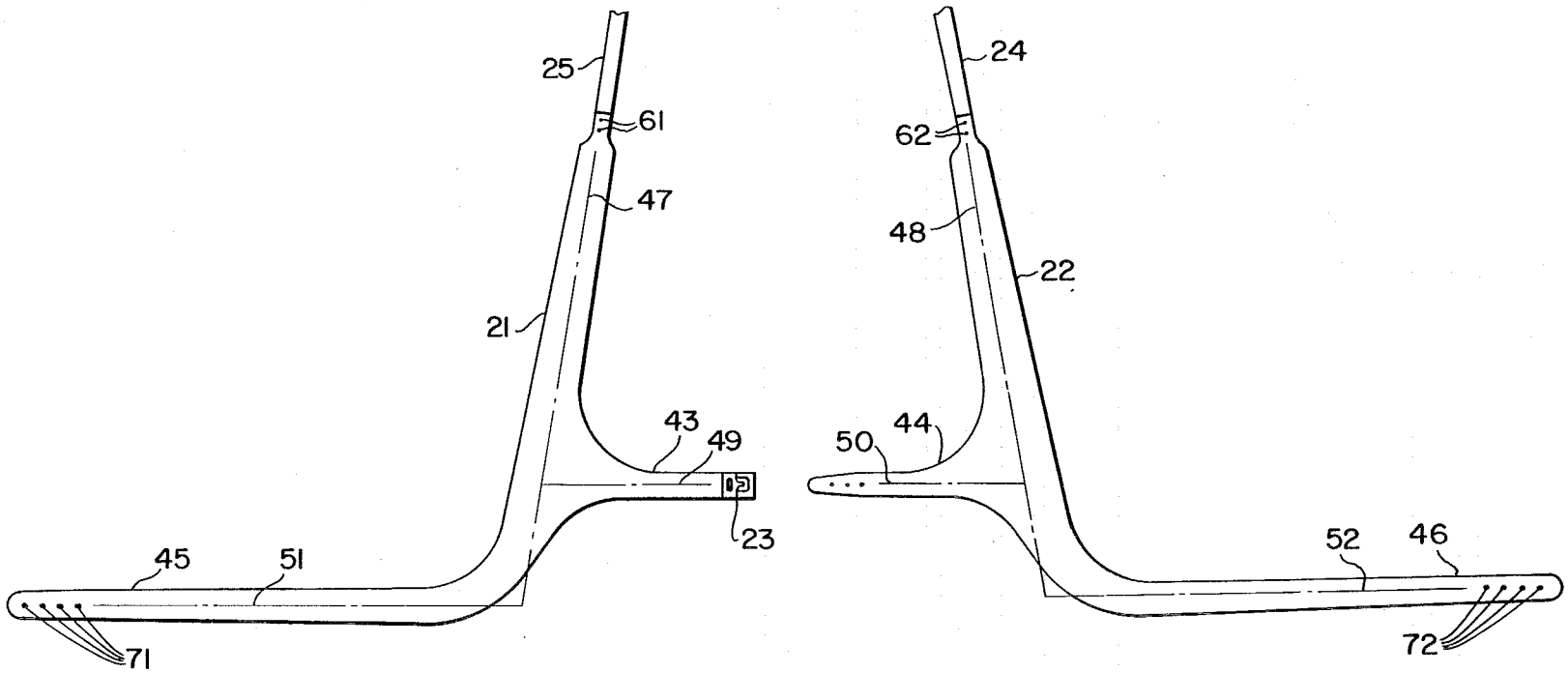
FIG. 3 is a plan view of the two halves of the present invention and related appertenances as though laid out in a plane.

The correct positioning of projections 43 and 44, vertically shown in FIG. 3, is important to the proper functioning to the support apparatus. If projections 43 and 44 were placed directly opposite and colinear with projections 45 and 46, a rotating moment would exist which would cause straps 21 and 22 to tend to slide off the shoulders of the user of the apparatus. On the other hand, were projections 43 and 44 to be placed substantially higher on straps 21 and 22 they would be too close to the back of the neck of the user and would place pressure and strain thereon, defeating the principle purpose of the invention. Therefore, due to these facts, the positioning of said projections 43 and 44 on support apparatus are on a ratio closely resembling 1:3 between projections 45 and 46, and fasteners 61 and 62.

Elongate projections 45 and 46 extending from shoulder straps 21 and 22 follow the contours of the body utilizing smooth curves to encircle the chest of the user and are joined together with adjustable snap fasteners 71 and 72. Said fasteners 71 and 72 may be any fastening devices as are known in the art. As shown in the drawings, projections 21,45 and 22,46 are substantially L-shaped.

As shown in FIG. 3, axes 47 and 48 intersect axes 51 and 52 respectively at an obtuse angle. This angle should be within the range of 95 and 110 degrees, and, in the embodiment of this invention, this angle measures 102 degrees. If these angles exceeding 110 degrees, straps 21 and 22 would create an uncomfortable scizzors effect on the sides of the neck. On the other hand, if said angles were to be less than 95 degrees, straps 21 and 22 would tend to slide off the shoulders of the user.

In the embodiment of the invention, as shown in FIG. 3, axes 51 and 52 are parallel to axes 49 and 50 respectively in order to position the elongate projections 45 and 46 and elongate projections 43 and 44 such that they provide the most comfort to the user while wearing the apparatus.

It should be noted that, as clearly shown in FIG. 4 webbing elements comprised of 24, 25, and 29, adjustable clamp 26 and hook 27, are not in any manner or form attached, permanently or temporarily, to elongate projections 45 and 46 thereby, allowing the musician to freely hold the instrument in a forwardly extended position.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed is:

1. An apparatus for supporting a musical instrument in front of a person and evenly distributing the weight of the instrument over the shoulders and across the back of said person comprising:

a pair of substantially L-shaped belts, each said belt including a shoulder strap portion and a chest strap portion; each of said belts including a back belt, such that when worn the shoulder strap portions rest on each shoulder and extend down the back of the wearer, the back belts are interconnected by an adjustable buckle, and the chest strap portions extend around the front of the wearer and are attached together by an adjustable buckle to form the apparatus; the shoulder strap portions include a permanently fastened, adjustable instrument attachment means, such that the instrument is attached in front of the wearer at only one point, and the device provides freedom of movement of the instrument.

2. The apparatus of claim 1 wherein the intersection of the shoulder strap portion and the chest strap portion form an obtuse angle, such that when apparatus is worn, the shoulder strap portions, back straps, and chest strap portions all lay flat against the contour of the body.

3. The apparatus of claim 1 wherein said back belts join said shoulder strap portions at a distance defined as substantially one-third the length of the shoulder strap portions above the point where the chest strap portions and said shoulder strap portions intersect; such that the circumference of the apparatus around the chest and back is greater than that of a complete circular belt, allowing more room for chest expansion when breathing.

* * * * *